United States Patent [19]

Satterwhite

[11] 3,982,341

[45] Sept. 28, 1976

[54] TRANSVERSE OSCILLATION FOR EXCAVATING AND LOADING SYSTEM

[75] Inventor: Charles R. Satterwhite, Dallas, Tex.

[73] Assignee: Unit Rig and Equipment Co., Tulsa, Okla.

[22] Filed: July 17, 1975

[21] Appl. No.: 596,680

Related U.S. Application Data

[63] Continuation-in-part of Ser. No. 435,296, Jan. 21, 1974, Pat. No. 3,896,571.

[52] U.S. Cl. ..... 37/190; 299/73

[51] Int. Cl.[2] ..... E02F 3/24

[58] Field of Search ..... 37/189, 190, 94–97, 37/91, DIG. 18, 87; 299/73, 71, 76, 77, 78, 56

[56] References Cited

UNITED STATES PATENTS

| | | | |
|---|---|---|---|
| 853,985 | 5/1907 | Linga | 37/94 |
| 1,346,679 | 7/1920 | Pratt | 37/190 B |
| 2,695,164 | 11/1954 | Arentzen | 299/71 |
| 3,091,874 | 6/1963 | Wuigk | 37/190 B |
| 3,121,558 | 2/1964 | Gonski et al | 299/73 X |
| 3,157,437 | 11/1964 | Gonski | 299/71 |
| 3,341,254 | 9/1967 | Arndt | 299/71 X |
| 3,469,885 | 9/1969 | Marberg | 299/71 |
| 3,500,563 | 3/1970 | Smith | 37/190 |
| 3,500,565 | 3/1970 | Smith | 37/190 |
| 3,612,610 | 10/1971 | Arentzen | 299/71 |

FOREIGN PATENTS OR APPLICATIONS

| | | | |
|---|---|---|---|
| 722,876 | 3/1932 | France | 37/190 B |
| 137,833 | 10/1956 | U.S.S.R. | 37/190 |
| 258,133 | 12/1970 | U.S.S.R. | 37/97 |

*Primary Examiner*—E.H. Eickholt

*Attorney, Agent, or Firm*—Richards, Harris and Medlock

[57] ABSTRACT

An excavating and loading system including an excavating wheel assembly at the front thereof and a plurality of conveyors for conveying material from the excavating wheel assembly to the rear of the vehicle. The excavating wheel assembly has an excavating wheel which is narrower than the overall width of the following portion of the system. A yoke engages the ends of the excavating wheel and supports the wheel in a horizontal position. The yoke is pivotally attached to the vehicle and hydraulic cylinders are provided to oscillate the excavating wheel assembly from side-to-side transverse to the direction of movement of the vehicle to form a trench wider than the excavating wheel assembly itself. Means are provided on the vehicle for raising and lowering the excavating height and can be provided to adjust the roll attitude of the excavation wheel assembly. The excavation wheel is provided with means for positively moving walls of a plurality of buckets between digging and dumping positions.

10 Claims, 4 Drawing Figures

TRANSVERSE OSCILLATION FOR EXCAVATING AND LOADING SYSTEM

CROSS REFERENCE TO RELATED APPLICATION

This application is a continuation-in-part of copending application Ser. No. 435,296, filed Jan. 21, 1974, for EXCAVATING AND LOADING SYSTEM, now U.S. Pat. No. 3,896,571.

BACKGROUND AND SUMMARY OF THE INVENTION

The present invention relates to improvements in excavating and loading systems which form an excavation of sufficient width to allow the following portion of the systems to move therethrough.

In large excavating and loading apparatus, for example, of the type capable of loading 4,000 cu. yds. of earth per hour, it has heretofore been known to utilize a system which forms a trench in the ground of sufficient width to allow the system to move through the trench behind the excavating portion of the system. However, although various examples of such excavating and loading systems have been designed previously, the need persists for considerable improvement in the art.

In accordance with the broader aspects of the invention, an improved excavating and loading system is disclosed having a vehicle, an excavating wheel assembly supported at the front of the vehicle, and means for oscillating the excavating wheel assembly from side-to-side to form an excavation of sufficient width to accommodate the following portion of the vehicle. A conveyor is provided to move material from the excavating wheel assembly to a delivery position at the rear of the vehicle.

In accordance with the preferred embodiment of the invention, an improved excavating and loading system is disclosed having a vehicle which comprises a main frame which is supported by a pair of driven wheels. A subframe has a second pair of wheels mounted thereon and an engine is supported on the subframe. The main frame and subframe are connected together for relative vertical movement so that the subframe can be raised and lowered with respect to the main frame. An excavating wheel assembly is rotatably supported on the subframe at the front of the vehicle. A conveyor is positioned behind the excavating wheel assembly for receiving material from the excavating wheel assembly and transporting the material rearward and upward. The excavating wheel assembly is mounted on a yoke which is pivotally connected to the subframe to pivot about a vertically-extending axis. A pair of double-acting hydraulic cylinders are connected between the yoke and the subframe. The cylinders, when actuated, can oscillate the excavating wheel assembly back and forth across the front of the vehicle. Movement of the excavating wheel assembly subscribes an arc wider than the widest portion of the following portion of the vehicle whereby the vehicle can move through the trench formed by the excavating wheel assembly. The yoke has arcuate surfaces for contacting the walls of the trench to stabilize the excavating wheel assembly. A blade and bearing plate are connected to the lower portion of the yoke for stabilizing excavating wheel means. A variable length double acting hydraulic cylinder is provided for adjusting the position of the bearing plate and the yoke. The excavating wheel assembly includes a plurality of digging buckets each including a wall which is supported for pivotal movement between a material receiving position and a material dumping position. Structure is provided for rotating the excavating wheel assembly and for operation of the movable wall of the bucket to first receive material and to subsequently dump the material onto the conveyor. An auxiliary conveyor with inner and outer portions can be provided on the rear of the vehicle for receiving material from the main conveyor and transporting material to the rear of the vehicle.

DESCRIPTION OF THE DRAWINGS

A more complete understanding of the present invention may be had by referring to the following Detailed Description when taken in conjunction with the accompanying Drawings wherein.

DETAILED DESCRIPTION

Figure 1:
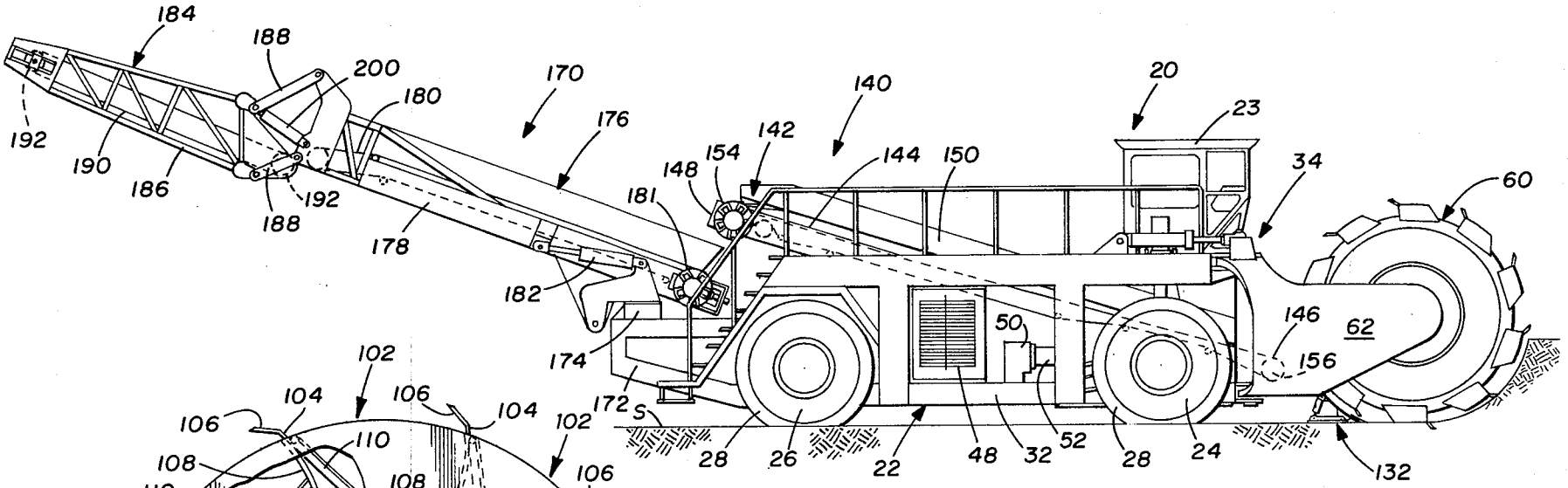
FIG. 1 is a side elevation of an excavating and loading system comprising the present invention.

Referring now to the Drawings, and particularly to FIG. 1, an excavating and loading system 20 incorporating the invention is shown. The system 20 comprises a vehicle 22 with an operator cab 23 and front wheels 24 and rear wheels 26 for movement along a surface S. Each of the wheels 24 and 26 comprises a pneumatic tire 28 whereby the excavating and loading system 20 is adapted for movement over highways and other paved surfaces as well as for operation in unpaved areas, such as during an excavating operation.

Figure 2:
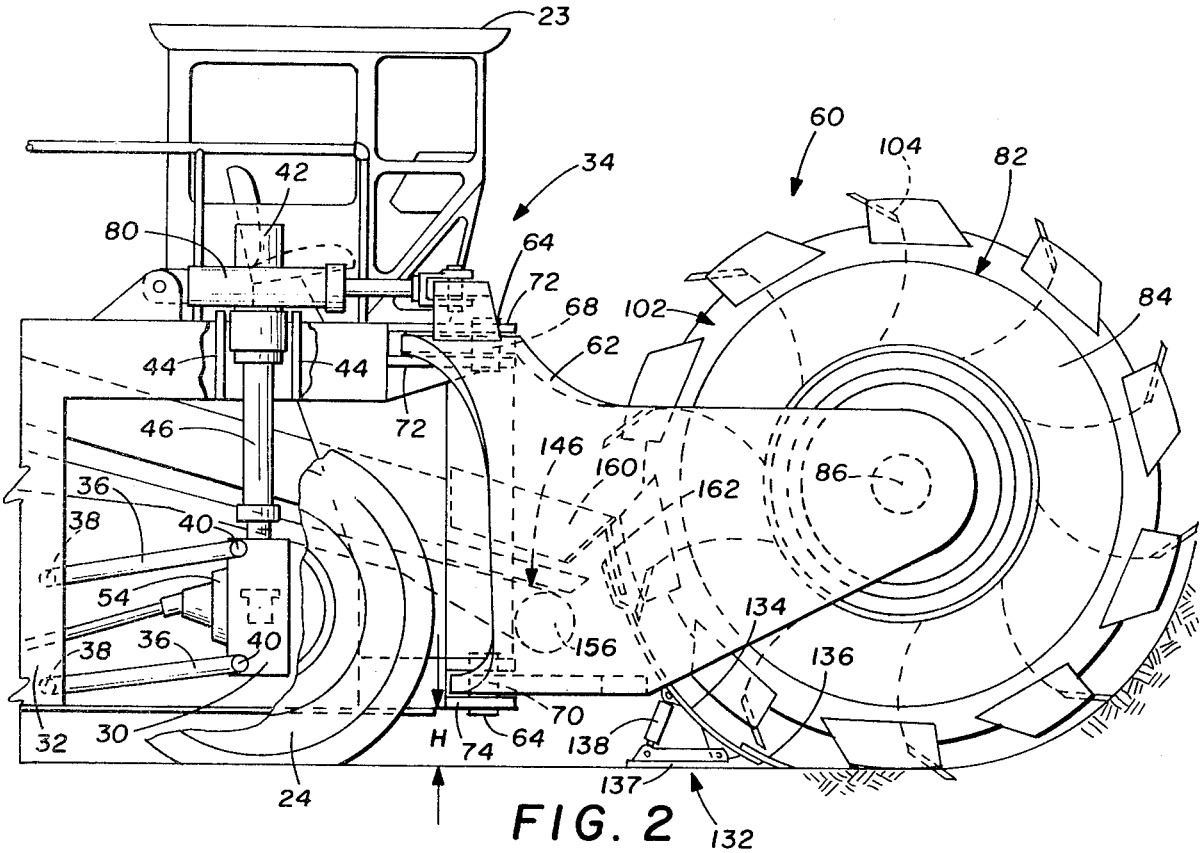
FIG. 2 is a partial enlarged side elevation of the front portion of the excavating and loading system illustrated in FIG. 1.

As is best illustrated in FIG. 2, the front wheels 24 are supported from a main frame 30. The rear wheels 26 are supported from a subframe 32. The main frame 30 comprises a rigid elongated member which extends between the front wheels 24 in a horizontal direction. A pair of link bars 36 are connected between each side of the main frame 30 and the subframe 32. Link bars 36 are positioned to extend in a spaced parallel relationship with their ends connected at 38 to the subframe 32 to pivot about horizontal axes. The other end of the link bars 36 are pivotally connected at 40 to the main frame 30 to pivot about horizontal axes. A pair of double-acting variable length hydraulic cylinder assemblies 42 are connected to subframe 32 by a pair of flanges 44. The rods 46 of the hydraulic cylinder assemblies 42 are connected to the main frame 30. By selectively actuating cylinders 42, the height "H" of the front end 34 of the subframe 32 can be raised or lowered. It is envisioned, of course, that the vehicle 22 could be provided with other types of wheels and frame structures as are well-known in the art.

In accordance with the illustrated embodiment of the invention, an engine 48 is supported on the subframe 32. The engine 48 is preferably of the internal combustion type and functions to drive a plurality of hydraulic pumps. The hydraulic pumps in turn supply operating power through suitable controls in cab 23 for the various components of the excavating and loading system 20. For example, one of the pumps supplies operating power for hydrostatic drive 50. Hydrostatic drive 50 is coupled to a transmission 52. The transmission 52 provides dual outputs which are coupled to a forward differential 54 coupled to front wheels 24 and a rear differential (not shown) coupled to rear wheels 26. Thus, the hydrostatic drive 50 operates wheels 24 and 26 to propel the excavating and loading system 20 during excavating operations and during travel. In this embodiment, the front wheels are provided with conventional steering mechanism for manipulating the vehicle as desired. If additional control over the vechicle is desired, rear wheel steering can also be provided.

Figure 3:
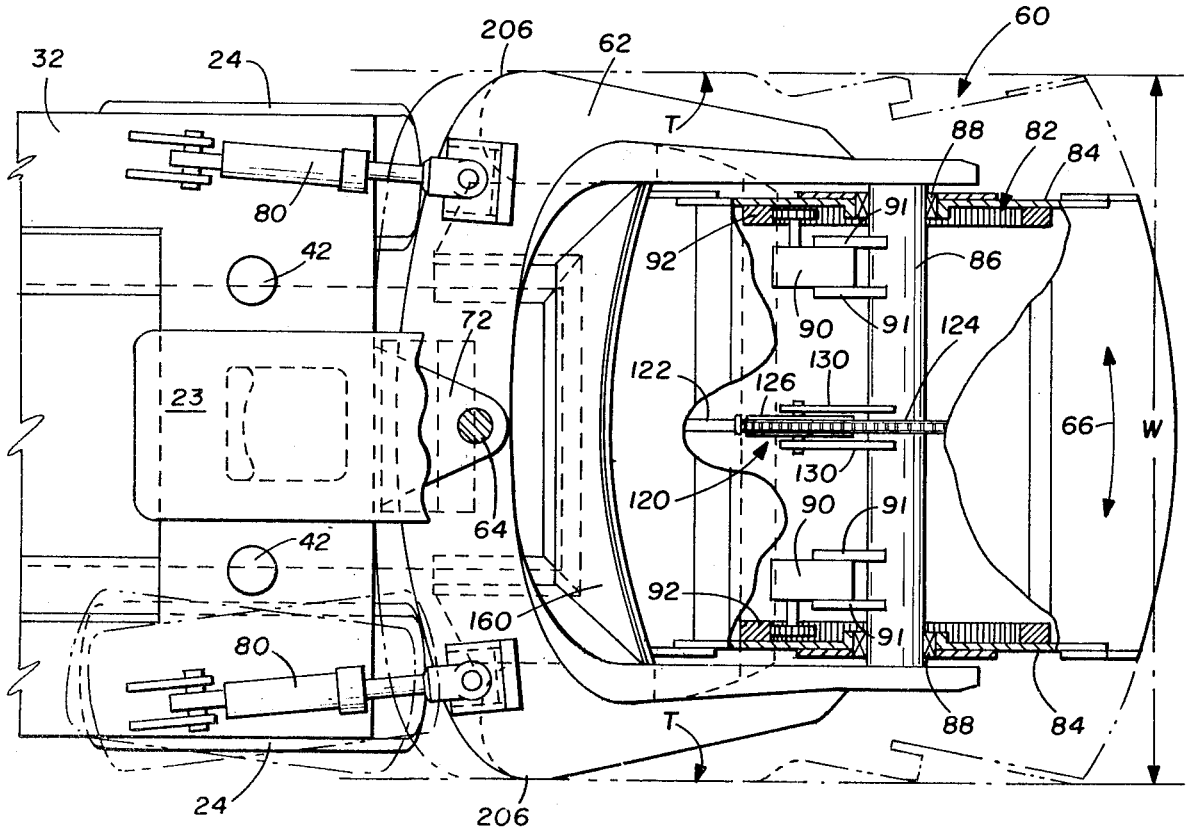
FIG. 3 is a partial enlarged plan view of the front portion of the excavating and loading system illustrated in FIG. 1.

An excavating wheel assembly 60 comprises the forward portion of the excavating and loading system 20. The excavating wheel assembly 60 includes a yoke 62 supported from the front of the subframe 32. The yoke 62 is connected to the subframe 32 by a vertically extending shaft 64 for oscillating movement about a vertical axis. Movement of the yoke 62 is from side-to-side in the direction of arrows 66, as shown in FIG. 3. The shaft 64 is coupled to the yoke 62 by means of upper and lower yoke portions 68 and 70, respectively. The upper yoke portion 68 fits between a pair of flanges 72 on the upper portion of the subframe 32, while the lower yoke portion 70 fits between flanges 74 on the lower portion of subframe 32.

A pair of double-acting variable length hydraulic cylinders 80 is coupled between the subframe 32 and the yoke 62. By selectively actuating the cylinders 80, the yoke 62 can be pivoted about shaft 64 between the positions illustrated in phantom lines.

The advantages of the oscillating excavating wheel assembly 60 are two-fold: First it increases the width of the excavation being formed by the system, and second it permits operation of the excavating and loading system within the trench T that is being formed. This materially reduces the amount of movement of the excavating wheel assembly 60 that is necessary to position the assembly for excavation and travel, and thereby reduces the overall complexity of the excavating and loading system incorporating the present invention.

Figure 4:
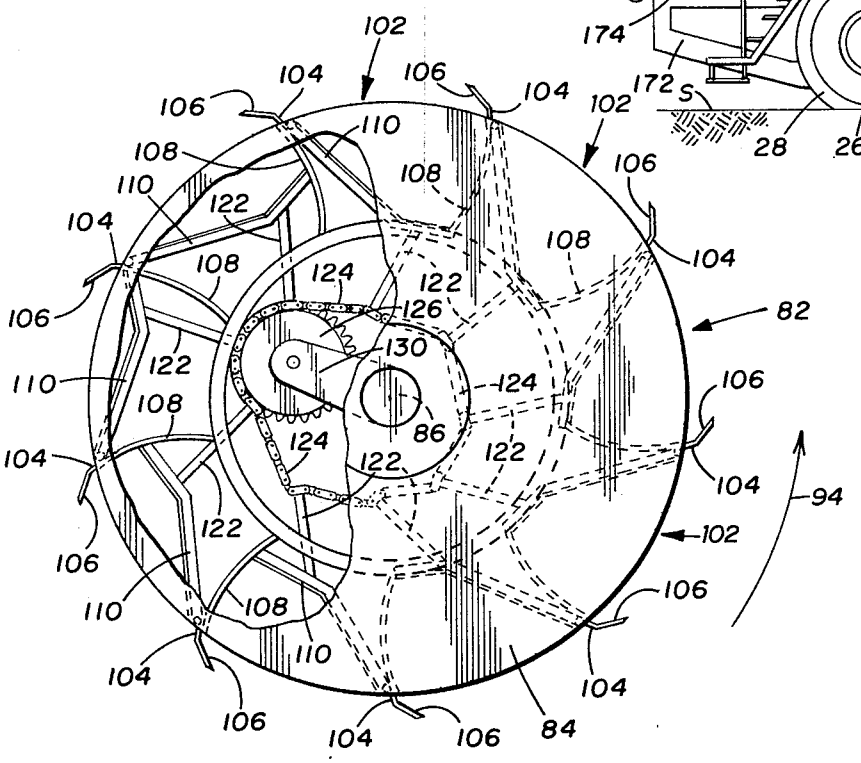
FIG. 4 is a side elevation partly in section of the system for actuating the rear plates of the digging buckets of the excavating and loading system incorporating the present invention.

The excavating wheel assembly 60 further comprises an excavating wheel 82 supported from the yoke 62 for rotation about a horizontally-extending axis. The excavating wheel 82 includes a pair of rims 84 which extend radially outward along the sides of the wheel. A shaft 86 is fixed to the yoke 62 to extend in a horizontal direction. Each of the rims 84 is rotatably supported from the shaft 86 by bearings 88. A pair of hydraulic motors 90 are each positioned inside the wheel 82 and are supported from flanges 91 in a fixed angular position relative to shaft 86. A pair of internal ring gears 92 is likewise positioned inside the wheel 82 adjacent to the rims 84. Each of the motors 90 is provided with an output sprocket which engages one of two ring gears 92 mounted inside wheel 82 to drive wheel 82 to rotate in the direction of arrow 94 as shown in FIGS. 2 and 4. Hydraulic lines communicating with the motors 90 are positioned in the yoke 62.

As shown in FIG. 4, the wheel 82 further comprises a plurality of digging buckets 102 which are equally spaced circumferentially around the wheel 82 and extend between the rims 84. The digging buckets 102 each have a cutting edge 104 including a plurality of teeth 106 and a stationary front wall 108, extending generally radially inward from the cutting edge 104. Each digging bucket further includes a rear wall 110 which is supported for pivotal movement between a digging position and a dumping position. The operation of the rear wall 110 is best shown in FIG. 4, wherein the wall is shown manipulated between a digging position where the respective buckets 102 are in the lower and forward position of their rotary motion and to a dumping position when the respective buckets are in the upper and rearward position of their rotary motion.

Referring particularly to FIGS. 3 and 4, an actuating system 120 for the digging buckets is shown. The system 120 is located completely within the margins of wheel 82 and comprises a plurality of push rods 122, each of which is connected between one of the rear walls 110 and a chain 124. The chain 124 is generally constrained and extends around a roller 126 which is supported on shaft 86 and which is secured against angular movement relative to the shaft 86 by brackets 130. The roller 126 is sprocketed on its outer periphery to engage the chain 124. As the excavating wheel 82 is rotated about the shaft 86 under the action of motors 90, each push rod 122 comes into engagement with the roller 126 whereupon its respective rear wall 110 is pushed outwardly to the material dumping position. Subsequently, as each digging bucket is rotated to the lower and forward portion of the circular path, the chain operates through the push rod 122 to positively return the rear wall 110 to the material digging position. This positive action of the rear wall 110 in both directions has been found to be vastly superior to the arrangement that has been used herebefore wherein the rear portions were allowed to return to the digging position under the action of gravity. It is envisioned, of course, that other positive acting actuating systems could be used such as those described in the earlier application, Ser. No. 435,296, now U.S. Pat. No. 3,896,571.

Positioned below and behind the excavating wheel 82 is a moldboard assembly 132. This moldboard assembly extends completely across the width of the wheel 82 and is provided to pick up loose material and crowd material in a forward direction as the excavating and loading system 20 moves. The assembly comprises a plate 134 which is curved to conform to the path of travel at the edges 104. A blade 136 is positioned adjacent the lower edge of the plate 134. The plate 134 is rigidly supported from the yoke 62. A bearing plate 137 is pivotally supported at its leading edge from the rear of the plate 134. A selectively operable double-acting hydraulic cylinder means 138 is pivotally attached between the trailing edge of the bearing plate 137 and the plate 134.

Thus, by manipulating control means provided in the cab 23, the effective length of the hydraulic cylinder 138 can be selectively varied to appropriately position the bearing plate 137 with respect to the yoke 62 as desired. This bearing plate can be adjusted to set the vertical pressure of the plate to reduce bouncing and stabilize the excavating system. In an appropriate situation the moldboard could be fixed to the digging wheel frame.

As is illustrated in FIGS. 1 and 2, the excavating and loading system 20 further includes a loading system 140. The loading system 140 includes a main conveyor 142 comprising an endless belt 144 mounted for movement around a course extending angularly upwardly relative to the subframe 32 of the vehicle 22 and including a lower material receiving portion 146 and an upper material delivery portion 148. More particularly, the course of the belt 144 is defined by a plurality of rollers (not shown) which are supported on a conveyor frame 150. The conveyor frame 150 is supported on the subframe 32 of the vehicle 22 and includes means supporting the upper portion 148 for pivotal movement about a horizontal axis under the action of the hydraulic cylinder (not shown). This permits control of the vertical height and allows folding of the material delivery portion 148 of the conveyor 142.

Belt 144 of the main conveyor 142 extends around a relatively small drum 154 mounted at the upper end of the frame 150 and around a relatively large drum 156 mounted on the subframe 32. The drums 154 and 156 are rotated by radial hydraulic motors (not shown) located within the drums 154 and 156. By this means, the belt 144 is moved around the course defined by the rollers to move material from the material receiving portion 146 to the material discharge or delivery portion 148.

A chute 160 is supported from the yoke 62 behind and below the excavating wheel 82 to receive material discharged from the buckets 102. The chute 160 is shaped to direct the material onto the material receiving portion 146 of the main conveyor 142 and has a plate 162, which cooperates with and overlaps the plate 134. This chute 160 directs material excavated by the excavating wheel 82 to the main conveyor 142 for transportation thereby from the material receiving portion 146 to the material delivery portion 148.

Referring now, particularly to FIG. 1, the disclosed embodiment of the invention further includes an auxiliary conveyor system 170. The auxiliary conveyor system 170 includes a frame 172 which is secured to the rear end of the subframe 32 of the vehicle 22. A turntable 174 is supported on the frame 172 for pivotal movement about a vertical axis under the action of hydraulic motor (not shown).

An inner conveyor 176 is supported on the turntable 174 to receive material discharged from the material delivery portion 148 of the main conveyor 142. The conveyor 176 comprises a frame 178 which is supported on the turntable 174 and an endless belt 180 mounted for movement around the course defined by a plurality of rollers. The belt 180 is driven by a radial hydraulic motor 181, and a hydraulic cylinder 182 is provided for controlling the angular relationship of the frame 178 to the turntable 174.

The auxiliary conveyor system 170 further includes an outer conveyor 184 comprising a frame 186 which is supported from frame 178 by upper and lower parallel links 188. An endless belt 190 is supported on the frame 186 for movement around a course defined by a pair of drums 192. The conveyor 184 is driven by small hydraulic motors (not shown) mounted in the drums 192.

A hydraulic cylinder 200 is pivotally connected between the frames 178 and 186 to manipulate the outer conveyor 184 with respect to the inner auxiliary conveyor 176. In this manner, the outer conveyor 184 may be manipulated to selectively receive material from the inner conveyor 170.

As will be appreciated by those of ordinary skill in the art, the yoke 62 is provided with convex surfaces 206 on either side thereof. As shown in FIG. 3, these surfaces 206 are positioned to contact the walls of the trench T being formed by the excavating wheel 82. These surfaces act as a reaction point or fulcrum for the side loads on the wheel.

In operation, the cylinders 80 are selectively actuated to oscillate the wheel 82 approximately 11° of either side of the center line. This oscillation can be accomplished by the use of a four-way cam operated valve that reverse itself at each limit of travel to control the supply of hydraulic fluid to the cylinders 80. In normal operation, excavating and loading systems do not excavate in a forward direction at a high rate of speed and consequently, the oscillation of the excavating wheel 82 need not be at a high frequency.

From the foregoing, it will be understood that the present invention comprises additional improvements relating to excavating and loading systems disclosed and claimed in co-pending application Ser. No. 435,296, Filed Jan. 21, 1974, now U.S. Pat. No. 3,896,571.

Thus, in accordance with the invention described herein, an excavating and loading system comprising a vehicle having an excavating wheel assembly supported on the front thereof is provided for excavating the material and transporting the material to a main conveyor whereupon the material is conveyed to the rear of the vehicle. The excavating wheel assembly itself is of a width narrower than the following portion of the vehicle. The excavating wheel is mounted on a yoke which oscillates from side-to-side transverse to the movement of the vehicle to form a trench wider than the vehicle itself. This allows the vehicle to follow in the trench with the yoke providing outside support for the wheel.

This particular arrangement provides advantages in that it allows for outside engagement of the excavation wheel which provides a more stable and less complicated system for operating the buckets and for supporting the wheel itself. In addition, this arrangement increases the width of the excavation being formed by the system and permits operation of the excavating and loading system within the trench or excavation that is being formed. This materially reduces the amount of movement of the excavating wheel assembly necessary to position the assembly for excavation and travel and thereby reduces the overall complexity of the excavating and loading system incorporating the present invention.

It is to be understood, of course, by those of ordinary skill in the art, that although the vehicle is illustrated with tired wheels, track type wheels could be utilized. In addition, the system is shown as utilizing an internal combustion engine with hydraulic pumps and motors to operate various elements of the system. It is envisioned that an internal combustion engine could be used with electric generators and motors to operate the various elements of the system without departing from the invention disclosed and claimed herein.

It is also envisioned that suitable apparatus could be mounted on the front of the vehicle 22 to provide pitch and roll adjustment for the excavating wheel assembly 60. This apparatus could simultaneously move the conveyor 142, chute 160 and moldboard assembly 132 as a unit with the excavating wheel assembly 60 to minimize clearance between these elements and reduce spillage.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit and scope of the invention as defined in the appended claims.

What is claimed is:

1. An excavating and loading system comprising in combination:

a vehicle, a main frame and a subframe on the vehicle;

means supporting the main frame of the vehicle for movement over a surface;

an excavating wheel means including a plurality of digging buckets located immediately adjacent one another to define the entire circumference of the excavating wheel and each having a cutting edge which extends to a stationary wall and a wall mounted for pivotal movement from a material receiving position to a material dumping position, said excavating wheel means being narrower than the widest portion of the vehicle;

a supporting and housing means rotatably supporting the excavating wheel means from the subframe whereby the excavating wheel means is positioned in the front of the main frame of the vehicle;

means for selectively varying the relative positioning of the subframe and the main frame whereby the excavating wheel means can be selectively raised or lowered to excavate at various depths;

drive means for rotating the excavating wheel means so that the digging buckets follow a circular path;

means located within the margins of the excavating wheel means and responsive to rotation thereof for positively positioning the movable wall in the material dumping position when the bucket is in the upper and rearward portion of the path;

conveyor means mounted on the vehicle entirely behind the excavating wheel assembly for movement around a course including a relatively low portion positioned to receive material from the digging buckets of the excavating wheel means and a material dumping position relatively high and located rearwardly on the vehicle;

means in said supporting and housing means for oscillating said excavating wheel means transverse to the direction of travel of the apparatus for forming an excavation wider than the widest portion of the vehicle whereby the vehicle can travel along the excavation;

said supporting and housing means comprising a yoke with the excavating wheel means mounted on said yoke for rotation about a horizontal axis;

said yoke being connected to said subframe to rotate about a vertically extending axis; and actuator means connected between said subframe and said yoke for selectively oscillating said yoke about said vertical axis.

2. The excavating and loading system of claim 1 wherein said supporting and housing means comprises surface means contacting the side walls of said excavation for stabilizing said excavating wheel means.

3. The excavating and loading system of claim 1 wherein said supporting and housing means comprises surface means contacting the side walls of said excavation for stabilizing said excavating wheel means.

4. The excavating and loading system according to claim 1 wherein said actuator means comprises at least one double-acting hydraulic cylinder.

5. The excavating and loading system according to claim 4 wherein the actuator means comprises a pair of double-acting hydraulic cylinders mounted on each side of the yoke.

6. An excavating and loading system comprising in combination:

a vehicle;

means supporting the vehicle for movement over a surface;

excavating wheel means including a plurality of digging buckets each having a cutting edge which extends to a stationary wall and a wall mounted for pivotal movement from a material receiving position to a material dumping position, said excavating wheel means being narrower than the widest portion of the vehicle;

means rotatably supporting the excavating wheel means on the vehicle whereby the excavating wheel means is positioned in the front of the vehicle;

means for selectively varying the relative positioning of the excavating wheel means and the vehicle whereby the excavating wheel means can be selectively raised or lowered to excavate at various depths;

drive means for rotating the excavating wheel means so that the digging buckets follow a circular path;

means located within the margins of the excavating wheel means and responsive to rotation thereof for positively positioning the movable wall in the material dumping position when the bucket is in the upper and rearward portion of the path;

conveyor means mounted on the vehicle entirely behind the excavating wheel assembly for movement around a course including a relatively low portion positioned to receive material from the digging buckets of the excavating wheel means and a relatively high material discharging position and located rearwardly on the vehicle;

means for oscillating said excavating wheel means transverse to the direction of travel of the apparatus for forming an excavation wider than the widest portion of the vehicle whereby the vehicle can travel along the excavation;

said means supporting said excavating wheel comprises a yoke with the excavating wheel means mounted on said yoke for rotation about a horizontal axis;

said yoke being connected to said vehicle to rotate about a vertically extending axis; and actuator means connected between said subframe and said yoke for selectively oscillating said yoke about said vertical axis.

7. The excavating and loading system of claim 6 wherein said means supporting said excavating wheel further comprises surface means contacting the side walls of said excavation for stabilizing said excavating wheel means.

8. The excavating and loading system of claim 6 wherein said means supporting said excavating wheel means further comprises surface means contacting the side walls of said excavation for stabilizing said excavating wheel means.

9. The excavating and loading system according to claim 6 wherein said actuator means comprises at least one double-acting hydraulic cylinder.

10. The excavating and loading system according to claim 9 wherein the actuator means comprises a pair of double-acting hydraulic cylinders mounted on each side of the yoke.

* * * * *

UNITED STATES PATENT OFFICE

CERTIFICATE OF CORRECTION

Patent No. 3,982,341 Dated September 28, 1976

Inventor(s) Charles R. Satterwhite

It is certified that error appears in the above-identified patent and that said Letters Patent are hereby corrected as shown below:

Column 7, line 60, Cancel Claim 3.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*